US011197092B2

(12) United States Patent
Sun et al.

(10) Patent No.: US 11,197,092 B2
(45) Date of Patent: Dec. 7, 2021

(54) IN-VEHICLE INDEPENDENT SOUND FIELD SYSTEM AND CONTROL SYSTEM BASED ON MINI-SPEAKERS

(71) Applicant: AAC Technologies Pte. Ltd., Singapore (SG)

(72) Inventors: Shuyuan Sun, Shenzhen (CN); Xingzhi Huang, Shenzhen (CN); Hao Yin, Shenzhen (CN); Xiang Huang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/994,693

(22) Filed: Aug. 17, 2020

(65) Prior Publication Data

US 2021/0029447 A1 Jan. 28, 2021

Related U.S. Application Data

(63) Continuation of application No. PCT/CN2019/093975, filed on Jun. 29, 2019.

(51) Int. Cl.
*H04R 1/40* (2006.01)
*H04R 1/02* (2006.01)

(52) U.S. Cl.
CPC ..... *H04R 1/403* (2013.01); *H04R 1/025* (2013.01); *H04R 2499/13* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,285,503 | A * | 2/1994 | Satoh | H04S 7/30 381/109 |
| 9,967,657 | B1 * | 5/2018 | Wang | H04R 1/025 |
| 2009/0136048 | A1 * | 5/2009 | Yoo | H04S 7/30 381/27 |
| 2014/0003620 | A1 * | 1/2014 | Rill | H04M 1/6091 381/86 |
| 2015/0181345 | A1 * | 6/2015 | Cai | H04R 9/06 381/412 |
| 2017/0105069 | A1 * | 4/2017 | Mezzomo | H04R 1/026 |
| 2017/0267138 | A1 * | 9/2017 | Subat | B60N 2/812 |
| 2019/0052967 | A1 * | 2/2019 | Kim | H04R 5/04 |

* cited by examiner

*Primary Examiner* — Duc Nguyen
*Assistant Examiner* — Assad Mohammed
(74) *Attorney, Agent, or Firm* — W&G Law Group

(57) ABSTRACT

An in-vehicle independent sound field system and control system based on mini-speakers are provided. The system includes a mini-speaker array installed in front of a user and a mini-speaker installed near the user's ear. Each mini-speaker is provided with a coupling rear cavity, and the mini-speaker near the user's ear is provided with a sound guide front cavity. A controller is provided to control the mini-speaker array to perform an intermediate-and-high frequency directional replay, and control the mini-speakers near the user's ear to perform low-frequency replay and autonomous counterbalance, to solve the problem that a speaker array cannot be installed with a traditional in-vehicle speaker size and that a low-frequency effect is bad when merely using a speaker array to control sound direction, Besides, when different sources are being played, they rarely interfere with each other, thereby improving personalized requirements for sound and user experience of users in a vehicle.

6 Claims, 7 Drawing Sheets

IN-VEHICLE INDEPENDENT SOUND FIELD SYSTEM AND CONTROL SYSTEM BASED ON MINI-SPEAKERS

TECHNICAL FIELD

The present disclosure relates to the technical field of in-vehicle audio device, in particular to an in-vehicle independent sound field system and control system based on mini-speakers.

BACKGROUND

With the rapid development of automotive electronics technology, a fine in-vehicle audio and video entertainment system becomes an indispensable part for providing superior driving experience. Users are no longer satisfied with high-quality and high-fidelity in-vehicle audio devices. More and more users tend to personalize an in-vehicle sound experience, that is, passengers in every position in a vehicle have varied needs for quality and content of sound. A traditional in-vehicle sound solution may provide one sound effect in an entire vehicle at a time, which cannot meet personalized requirements of users. A new user experience means that users are free to choose sounds they intend to listen to without interference between different positions.

There is not yet an absolutely mature technical solution for solving the above problem. In principle, a speaker array may be configured to realize directional control of sound so that sound is concentrated in a certain region to achieve the above effect. However, the following problems exist: firstly, in order to form a speaker array, a number of sounding units have to be placed in a particular region according to a certain rule. However, a traditional in-vehicle speaker unit is generally a large-diameter circular moving-coil electroacoustic transducer with a large size, but in such a small space as a vehicle, it is difficult to install a plurality of speakers in a particular region according to a certain rule. Secondly, the directional control of a speaker may only result in a good effect at intermediate and high frequencies, but sound can still spread around at low frequencies, resulting in bad effect of sound separation between different positions in the entire car, interference between users and bad user experience.

Therefore, it is necessary to provide an in-vehicle sound system, by which passengers may be free to choose sounds that are required without interference between different positions.

SUMMARY

The present disclosure is intended to provide an in-vehicle independent sound field system and control system based on mini-speakers, which may solve the existing problem that only one sound effect can be played at a time in an entire vehicle in an in-vehicle acoustic solution and cannot satisfy user's personalized experience requirements.

The technical solutions of the present disclosure are as follows:

an in-vehicle independent sound field system based on mini-speakers, includes a mini-speaker array and a plurality of second mini-speakers, the mini-speaker array consisting of a plurality of first mini-speakers.

each first mini-speaker includes a first housing having a first cavity, a first front cover covering the first housing and a first sounding unit accommodated in the first housing. The first sounding unit is fixed to the first front cover, and the first front cover, the first sounding unit and the first housing cooperatively define a first coupling rear cavity.

each second mini-speaker includes a second housing having a second cavity, a second front cover covering the second housing, a second sounding unit accommodated in the second cavity and a second upper cover covering the second front cover. The second sounding unit is fixed to the second front cover, the second front cover, the second sounding unit and the second housing cooperatively defining a second coupling rear cavity, and the second front cover and the second upper cover cooperatively define a sound-guide front cavity.

Further, the mini-speaker array is installed in a region in front of a user and each second mini-speaker is installed in a region close to an ear of a user.

Further, the first front cover is provided with a first sound outlet at a position corresponding to the first sounding unit.

Further, the second front cover is provided with a second sound outlet at a position corresponding to the second sounding unit.

Further, the second upper cover includes a top wall disposed opposite to the second front cover and a side wall bending and extending from an edge of the top wall towards the second front cover, the side wall is fixedly connected with the second front cover and the side wall is provided with a leakage hole communicating the sound-guide front cavity with the outside.

In order to solve the above technical problem, the present invention further provides an in-vehicle independent sound field control system based on mini-speakers, including a controller, a mini-speaker array installed in a region in front of a user and consisting of a plurality of first mini-speakers, and a plurality of second mini-speakers installed in a region close to an ear of a user. The controller is configured to control the mini-speaker array to replay intermediate-and-high-frequency signals, and realizes directional control of sound by utilizing a preset program in the controller. The controller is further configured to control the plurality of second mini-speaker to replay low-frequency signals and realizes counterbalance to low-frequency signals transmitted from other regions by utilizing another preset program in the controller.

Further, the plurality of first mini-speakers cooperatively form a line array or a plane array.

Further, the region in front of the user, where the mini-speaker array is installed, includes backs of front seats, and the region close to an ear of a user, where the plurality of second mini-speaker are installed, includes a side surface of a rear seat.

Further, each first mini-speaker and each second mini-speaker include a coupling rear cavity, and each second mini-speaker includes a sound-guide front cavity.

Further, each first mini-speaker has a central sound hole communicating the coupling rear cavity with the outside, and each second mini-speaker has a side sound hole communicating the sound-guide front cavity with the outside.

The present disclosure is advantageous as follows: the mini-speaker array installed in the region in front of the user is configured to perform an intermediate- and high-frequency directional replay, which cooperates with the solution of performing low-frequency replay and autonomous counterbalance by the mini-speaker installed in the region near the user's ear, thereby solving the problem that a speaker array cannot be installed in a vehicle with a traditional in-vehicle speaker size and that a low-frequency effect is not good enough if merely a speaker array is used to control sound direction. An independent sound field control in each region of seats in a vehicle is realized. Besides, when different program sources are being played, they rarely interfere with each other, thereby improving personalized requirements for sound and user experience of users in a vehicle.

DETAILED DESCRIPTION

Figure 1:
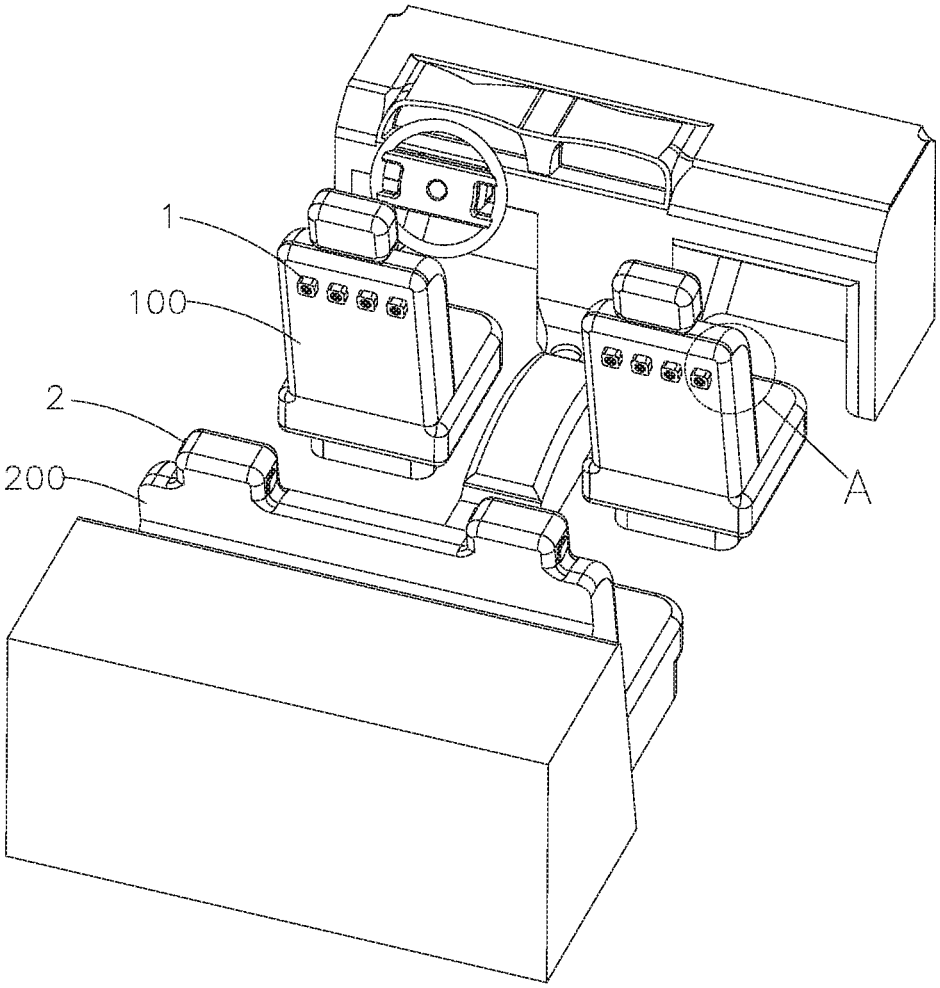
FIG. 1 is a schematic structural view of an in-vehicle independent sound field system based on mini-speakers provided by an embodiment of the present disclosure.
Figure 2:
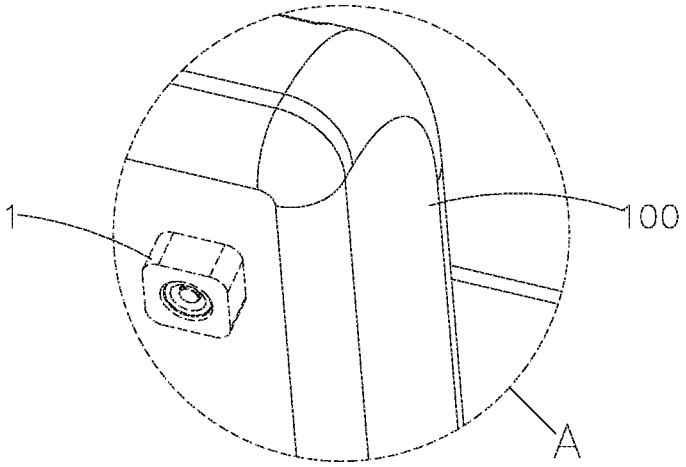
FIG. 2 is a zoomed-in view of A of the in-vehicle independent sound field system shown in FIG. 1.
Figure 3:
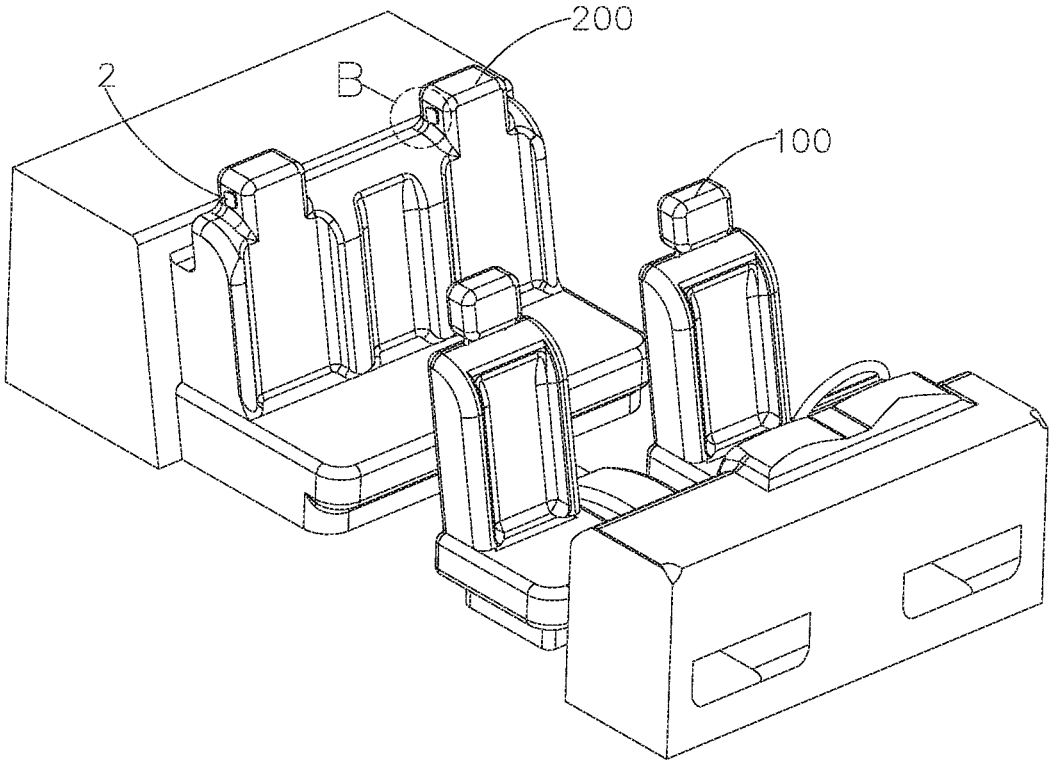
FIG. 3 is a schematic structural view of the in-vehicle independent sound field system from another perspective view.
Figure 4:
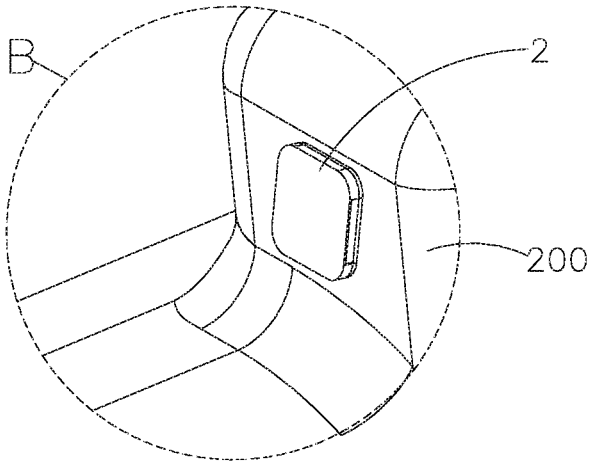
FIG. 4 is a zoomed-in view of B of the in-vehicle independent sound field system shown in FIG. 3.
Figure 5:
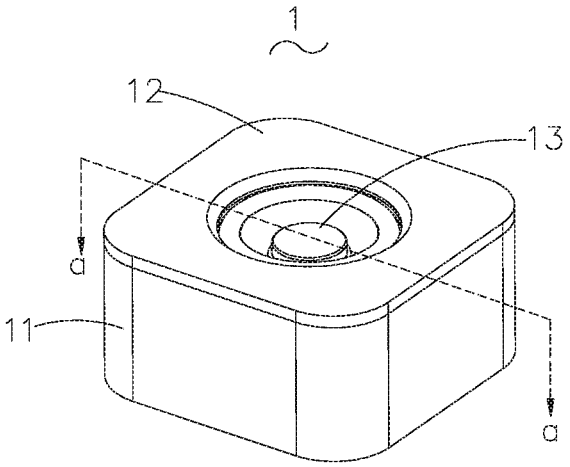
FIG. 5 is a schematic structural perspective view of a first mini-speaker in the in-vehicle independent sound field system shown in FIG. 1.
Figure 6:
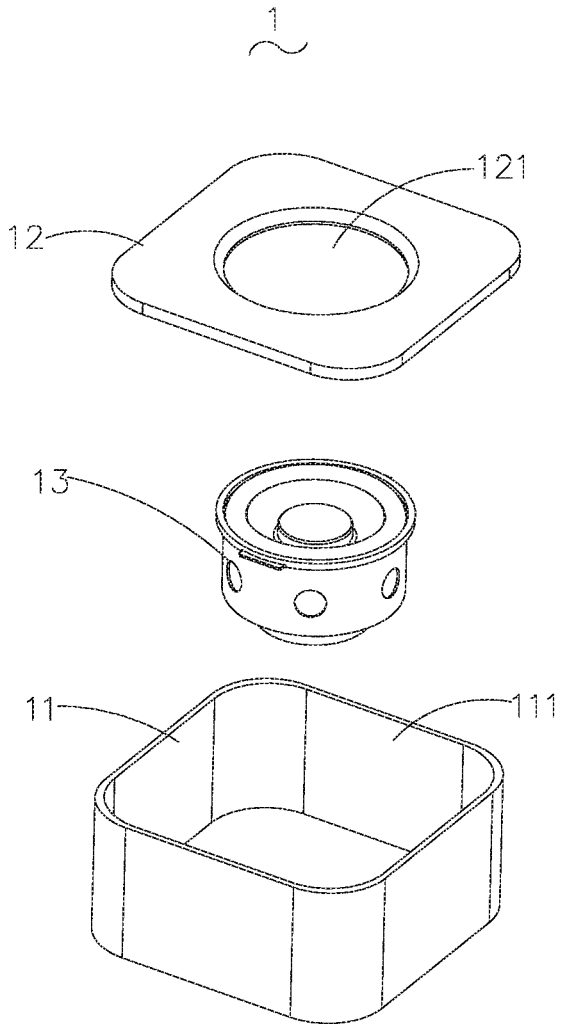
FIG. 6 is an schematic exploded structural view of the first mini-speaker in FIG. 5.
Figure 7:
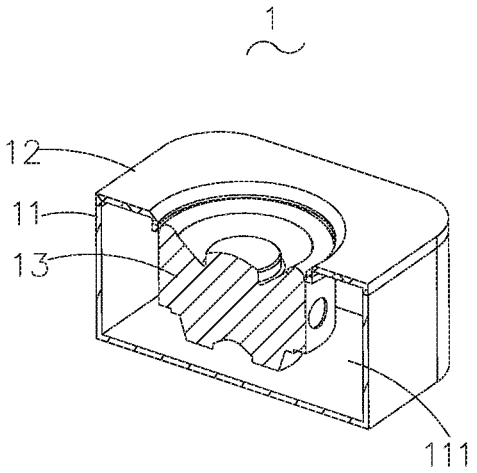
FIG. 7 is a schematic sectional view along an a-a sectional line of the first mini-speaker shown in FIG. 5.
Figure 8:
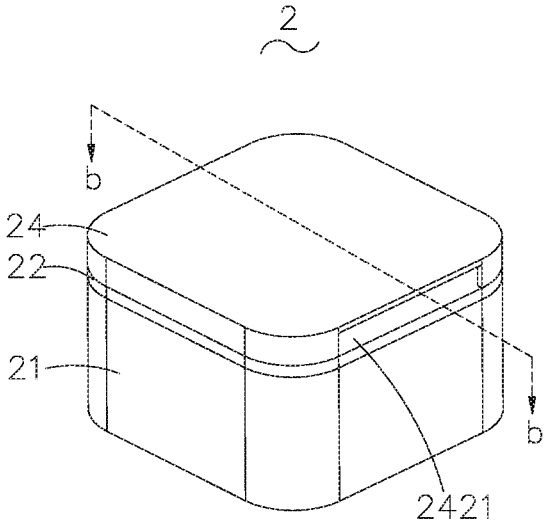
FIG. 8 is a schematic structural perspective view of a second mini-speaker in the in-vehicle independent sound field system shown in FIG. 1.
Figure 9:
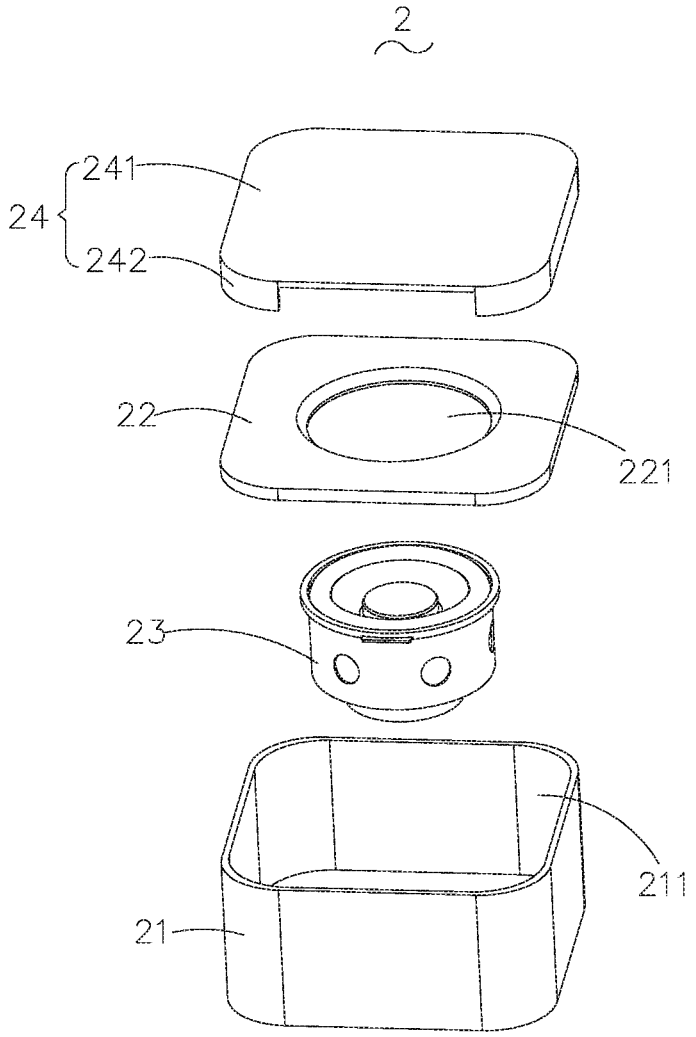
FIG. 9 is an schematic exploded structural view of the second mini-speaker in FIG. 8.
Figure 10:
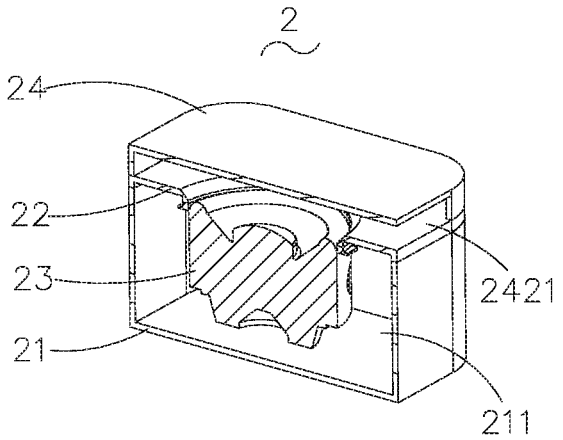
FIG. 10 is a schematic sectional view along a b-b sectional line of the second mini-speaker shown in FIG. 8.

A further description is provided with reference to the drawings and embodiments.

FIGS. 1 to 4 show a preferable embodiment of the present disclosure. An in-vehicle independent sound field system based on mini-speakers, includes a mini-speaker array and a plurality of second mini-speakers 2, the mini-speaker array consisting of a plurality of first mini-speakers 1.

A first mini-speaker 1 includes a first housing 11 having a first cavity 111, a first front cover 12 covering the first housing 11 and a first sounding unit 13 accommodated in the first housing 11. The first sounding unit 13 is fixed beneath the first front cover 12. The first front cover 12, the first sounding unit 13 and the first housing 11 cooperatively define a first coupling rear cavity. The first front cover 12 is provided with a first sound outlet 121 at a position corresponding to the first sounding unit 13. The first sound outlet 121 is a central sound hole communicating the first coupling rear cavity with the outside.

A second mini-speaker 2 includes a second housing 21 having a second cavity 211, a second front cover 22 covering the second housing 21, a second sounding unit 23 accommodated in the second cavity 211 and a second upper cover 24 covering the second front cover 22. The second sounding unit 23 is fixed beneath the second front cover 22. The second front cover 22, the second sounding unit 23 and the second housing 21 cooperatively define a second coupling rear cavity. The second front cover 22 and the second upper cover 24 cooperatively define a sound-guide front cavity. The second front cover 22 is provided with a second sound outlet 221 at a position corresponding to the second sounding unit 23. The second sound outlet 221 is a side sound hole communicating the sound-guide front cavity with the outside.

The second upper cover 24 includes a top wall 241 disposed opposite to the second front cover 22 and a side wall 242 bending and extending from an edge of the top wall 241 towards the second front cover 22, the side wall 242 is fixedly connected with the second front cover 22 and the side wall 242 is provided with a leakage hole 2421 communicating the sound-guide front cavity with the outside.

In this embodiment, the plurality of first mini-speakers 1 cooperatively form a line array or a plane array. The mini-speaker array is installed in a region in front of a user; and the plurality of second mini-speakers 2 are installed in a region close to a user's ear.

An embodiment of the present disclosure further provides a control system for controlling the above in-vehicle independent sound field system. In the control system, a controller is added to the in-vehicle independent sound field system.

The controller is configured to control a mini-speaker array that is installed in a region in front of a user and that consist of a plurality of first mini-speakers 1 to replay intermediate-and-high-frequency signals, and to realize directional control of sound by utilizing a preset program in the controller so that sound is directed to a particular user region. The intermediate-and-high-frequency signals may be but not limited to those intermediate-and-high-frequency signals whose frequency is greater than 200 Hz, so as to ensure good directional control. The directional control of the mini-speaker array results in good effect at intermediate and high frequencies but sound is greatly spread at low frequency. In order to have a good independent sound field control in a vehicle, a mini-speaker array is composed by a plurality of highly sensitive first mini-speakers 1, in order to achieve sufficient middle-and-high-frequency volume. Since the first mini-speakers 1 are small and thin, they may be installed in a small space just in front of a user in a vehicle. In an embodiment, the first mini-speaker 1 may be installed in the rear of a front seat 100.

In order to realize sound replay at all frequency bands, the controller is further configured to control the second mini-speakers 2 that is installed in a region near a user's ear to replay low-frequency signals and realize counterbalance to low-frequency signals transmitted from other regions by utilizing another preset program in the controller. The second mini-speaker 2 is a mini-speaker of low frequency and broad amplitude, so that the second sounding unit may ensure sufficient low-frequency output sound pressure level even if the second sounding unit is of a small size. The second mini-speaker 2 cooperates with its sound guide front cavity to perform, on the one hand, physical high-frequency filtering and low-frequency enhancement at a resonant frequency and, on the other hand, to reduce a size of an outlet to make better appearance. Further, the second mini-speaker 2 takes advantages of its characteristics of small size and thinness to realize installation in a small space in the region near a user's ear. In an embodiment, the second mini-speaker 2 is installed at both sides of rear seats 200.

Further, sound signals sent to the second mini-speaker 2 installed in the region near a user's ear includes a low-frequency component of sound signals that the user needs to hear in this region. It is sufficient as long as a loudness of the input sound signals ensures that a sufficient low-frequency listening sensation is generated in the user region so that sound is prevented from spreading to other regions.

Further, sound signals sent to the second mini-speaker 2 installed in the region near a user's ear includes inverse signals of low-frequency sound replayed in other regions, so as to cancel low-frequency sound spread from mini-speakers in other regions, thereby further strengthening sound separation between different user regions in the vehicle. It is sufficient as long as the loudness of the input sound signals can cancel low-frequency sound spread from other regions so as to prevent sound signals the user expects to hear from being affected.

In view of above, in this embodiment, the mini-speaker array installed in the region in front of the user is configured to perform a high-frequency directional replay, which cooperates with the solution of performing low-frequency replay and autonomous counterbalance by the second mini-speaker installed in the region near the user's ear, thereby solving the problem that a speaker array cannot be installed in a vehicle with a traditional in-vehicle speaker size and that a low-frequency effect is not good enough if merely a speaker array is used to control sound direction. An independent sound field control in each region of seats in a vehicle is realized. Besides, when different program sources are being played, they rarely interfere with each other, thereby improving personalized requirements for sound and user experience of users in a vehicle.

Figure 11:
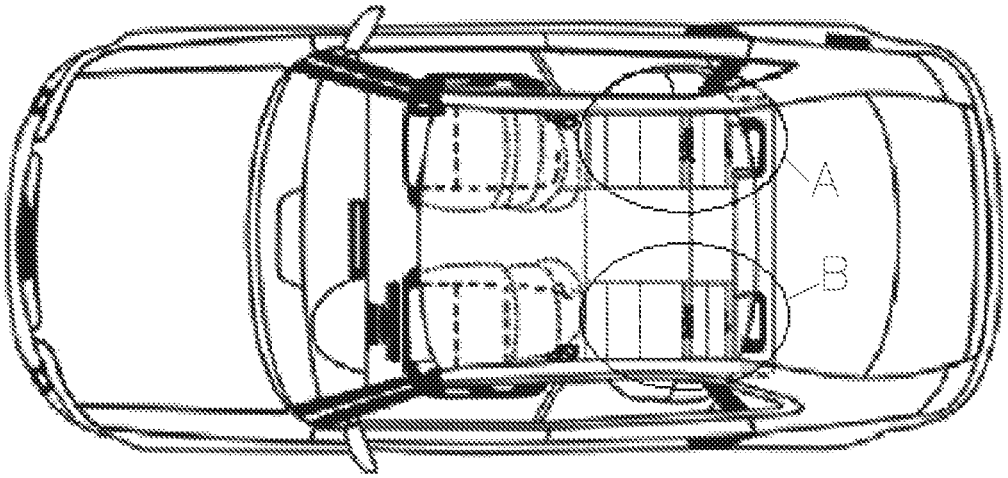
FIG. 11 is a schematic view of an effect of controlling the sound field system by an in-vehicle independent sound field control system provided by an embodiment of the present disclosure.

FIG. 11 is a schematic view of an effect of controlling the sound field system by an in-vehicle independent sound field control system provided in an embodiment of the present disclosure. Sound regions of rear seats are divided into region A and region B. Sound field of each region are respectively controlled by the mini-speaker array installed at front seats and the second mini-speakers installed in regions near users' ears. Sound in region A and sound in region B do not interfere with each other. When a user is using the in-vehicle audio system, a user in region A may choose to listen to respective program signals based on his/her requirement and the sound does not affect a passenger in region B. Similarly, a user in region B may choose to listen to respective program signals based on his/her requirement and the sound does not affect a passenger in region A.

The above are only embodiments of the present disclosure. It shall be indicated that those of ordinary skill in the art can make improvements without departing from the creative concept of the present disclosure, and these belong to the protection scope of the present disclosure.

What is claimed is:

1. An in-vehicle independent sound field control system based on mini-speakers, comprising a controller and a plurality of sound regions, the plurality of sound regions each having an independent sound field and not interfering with each other, each sound region comprises a mini-speaker array installed in a region in front of a user and consisting of a plurality of first mini-speakers, and a plurality of second mini-speakers installed in a region close to an ear of a user; wherein the controller is configured to control the mini-speaker array to replay intermediate-and-high-frequency signals for a user to hear in this region, and realize directional control of intermediate-and-high-frequency sound by utilizing a preset program in the controller; and wherein the controller is further configured to control the plurality of second mini-speakers to replay low-frequency signals for a user to hear in this region, and to replay inverse signals of low-frequency signals replayed in other regions for counterbalancing low-frequency sound transmitted from other regions by utilizing another preset program in the controller.

2. The in-vehicle independent sound field control system according to claim 1, wherein the plurality of first mini-speakers cooperatively form a line array or a plane array.

3. The in-vehicle independent sound field control system according to claim 1, wherein the region in front of the user, where the mini-speaker array is installed, comprises backs of front seats, and the region close to an ear of a user, where the plurality of second mini-speaker are installed, comprises a side surface of a rear seat.

4. The in-vehicle independent sound field control system according to claim 1, wherein each first mini-speaker and each second mini-speaker each comprise a coupling rear cavity, and each second mini-speaker comprises a sound-guide front cavity.

5. The in-vehicle independent sound field control system according to claim 4, wherein each first mini-speaker has a central sound hole communicating the coupling rear cavity with the outside, and each second mini-speaker has a side sound hole communicating the sound-guide front cavity with the outside.

6. The in-vehicle independent sound field control system according to claim 1, wherein each first mini-speaker comprises a first housing having a first cavity, a first front cover covering the first housing and a first sounding unit accommodated in the first housing; the first sounding unit being fixed to the first front cover, and the first front cover, the first sounding unit and the first housing cooperatively defining a first coupling rear cavity; each second mini-speaker comprises a second housing having a second cavity, a second front cover covering the second housing, a second sounding unit accommodated in the second cavity and a second upper cover covering the second front cover; the second sounding unit being fixed to the second front cover, the second front cover, the second sounding unit and the second housing cooperatively defining a second coupling rear cavity, and the second front cover and the second upper cover cooperatively defining a sound-guide front cavity, the first front cover is provided with a first sound outlet at a position corresponding to the first sounding unit; the second front cover is provided with a second sound outlet at a position corresponding to the second sounding unit, the second upper cover comprises a top wall disposed opposite to the second front cover and a side wall bending and extending from an edge of the top wall towards the second front cover, the side wall is fixedly connected with the second front cover and the side wall is provided with a leakage hole communicating the sound-guide front cavity with the outside.

* * * * *